US007917052B2

(12) United States Patent
Takaya et al.

(10) Patent No.: US 7,917,052 B2
(45) Date of Patent: Mar. 29, 2011

(54) CHARGING DEVICE AND AN IMAGE FORMING APPARATUS PROVIDED WITH THE CHARGING DEVICE

(75) Inventors: Shunichi Takaya, Hino (JP); Osamu Maeda, Sanda (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 12/827,313

(22) Filed: Jun. 30, 2010

(65) Prior Publication Data

US 2011/0002706 A1 Jan. 6, 2011

(30) Foreign Application Priority Data

Jul. 1, 2009 (JP) ..... 2009-156856

(51) Int. Cl.
*G03G 15/02* (2006.01)

(52) U.S. Cl. ..... 399/100; 399/115; 399/173

(58) Field of Classification Search ..... 399/91, 399/98–101, 107, 110, 115, 168, 170–173
See application file for complete search history.

(56) References Cited

U.S. PATENT DOCUMENTS

| | | | | |
|---|---|---|---|---|
| 5,532,798 | A * | 7/1996 | Nakagami et al. | 399/170 |
| 6,580,885 | B2 | 6/2003 | Walgrove, III et al. | |
| 7,003,243 | B2 * | 2/2006 | Yamashita | 399/100 |
| 2008/0268361 | A1 * | 10/2008 | Kikuchi | 430/97 |

FOREIGN PATENT DOCUMENTS

| | | | |
|---|---|---|---|
| JP | 2002-268342 | A | 9/2002 |
| JP | 2004-93962 | A | 3/2004 |

* cited by examiner

*Primary Examiner* — David P Porta
*Assistant Examiner* — Jessica L Eley
(74) *Attorney, Agent, or Firm* — Buchanan Ingersoll & Rooney PC

(57) ABSTRACT

A charging device has a stainless steel sheet electrode for charging an image bearing member, and a cleaner for cleaning the stainless steel sheet electrode. The stainless steel sheet electrode has a thickness within a range from 50 μm to 60 μm and comprises aligned triangular pins. Each of the triangular pins has a vertex angle within a range from 10 degrees to 30 degrees. The cleaner has two grinding members comprising abrasive grains having an average diameter within a range from 2 μm to 9 μm, and the two grinding members are in contact with, respectively, both main surfaces of the sheet electrode. The cleaner and the sheet electrode are moved relative to each other at a constant speed by a force equal to or less than 2N.

6 Claims, 6 Drawing Sheets

CHARGING DEVICE AND AN IMAGE FORMING APPARATUS PROVIDED WITH THE CHARGING DEVICE

This application is based on Japanese Patent Application No. 2009-156856 filed on Jul. 1, 2009, the content of which is incorporated herein by reference.

BACKGROUND OF THE INVENTION

1. Filed of the Invention

The present invention relates to a charging device and an image forming apparatus provided with the charging device, and more particularly to a charging device for charging an image bearing member and an image forming apparatus provided with the charging device.

2. Description of Related Art

An example of conventional charging devices is a corona charging device as disclosed by Japanese Patent Laid-Open Publication No. 2002-268342 (Reference 1). In the corona charging device, a corona wire is used. A high-voltage source is connected to the corona wire, and thereby, a discharge from the corona wire occurs.

Regarding such a corona charging device, as the discharge occurs again and again, silicon oxide and other substances adhere to the corona wire, and corona products, which are called as needles, are formed on the corona wire. Due to the corona products, the discharge from the corona wire becomes uneven, thereby causing a fault in charging. This is a cause of image noise.

In order to solve this problem, the corona charging device disclosed by Reference 1 has a cleaning assembly including a cylindrical grinding stone made of aluminum oxide. By a slide of the cylindrical grinding stone on the corona wire, the corona products deposited on the corona wire are removed.

In recent years, charging devices of a type that has a sheet electrode with aligned triangular pins are developed for practical use. This type of charging devices having a sheet electrode has the advantage over the charging device disclosed by Reference 1 of generating less ozone. However, the type of charging devices having a sheet electrode has the same problem as the charging device disclosed by Reference 1 in that corona products are generated. Therefore, also in this type of charging devices, it is necessary to clean the sheet electrode regularly.

The type of charging devices having a sheet electrode has also a problem that the pins are fragile. More specifically, an exemplary way of cleaning the sheet electrode is touching a grinding stone made of aluminum oxide as disclosed by Reference 1 to main surfaces of the sheet electrode; however, because the tips of the pins of the sheet electrode are sharp, the pins are relatively fragile. In carrying out this way of cleaning, therefore, the tips of the pins of the sheet electrode may be bent and/or cracked at a touch of the grinding stone. Then, the bent/cracked tips of the pins of the sheet electrode will cause a poor discharge, which results in degradation of picture quality.

SUMMARY OF THE INVENTION

An object of the present invention is to provide a charging device wherein breaks of triangular pins of a sheet electrode can be prevented and an image forming apparatus provided with the charging device.

A charging device according to an embodiment of the present invention comprises: a stainless steel sheet electrode for charging an image bearing member, the stainless steel sheet electrode having a thickness within a range from 50 μm to 60 μm and comprising aligned triangular pins, each of the triangular pins having a vertex angle within a range from 10 degrees to 30 degrees; and a cleaner for cleaning the stainless steel sheet electrode, the cleaner having two grinding members comprising abrasive grains having an average diameter within a range from 2 μm to 9 μm, the two grinding members being in contact with, respectively, both main surfaces of the sheet electrode, wherein the cleaner and the sheet electrode are moved relative to each other at a constant speed by a force equal to or less than 2N.

BRIEF DESCRIPTION OF THE DRAWINGS

This and other objects and features of the present invention will be apparent from the following description with reference to the accompanying drawings, in which.

DETAILED DESCRIPTION OF THE PREFERRED EMBODIMENTS

A charging device according to an embodiment of the present invention and an image forming apparatus provided with the charging device are hereinafter described with reference to the drawings.

General Structure of the Image Forming Apparatus

Figure 1:
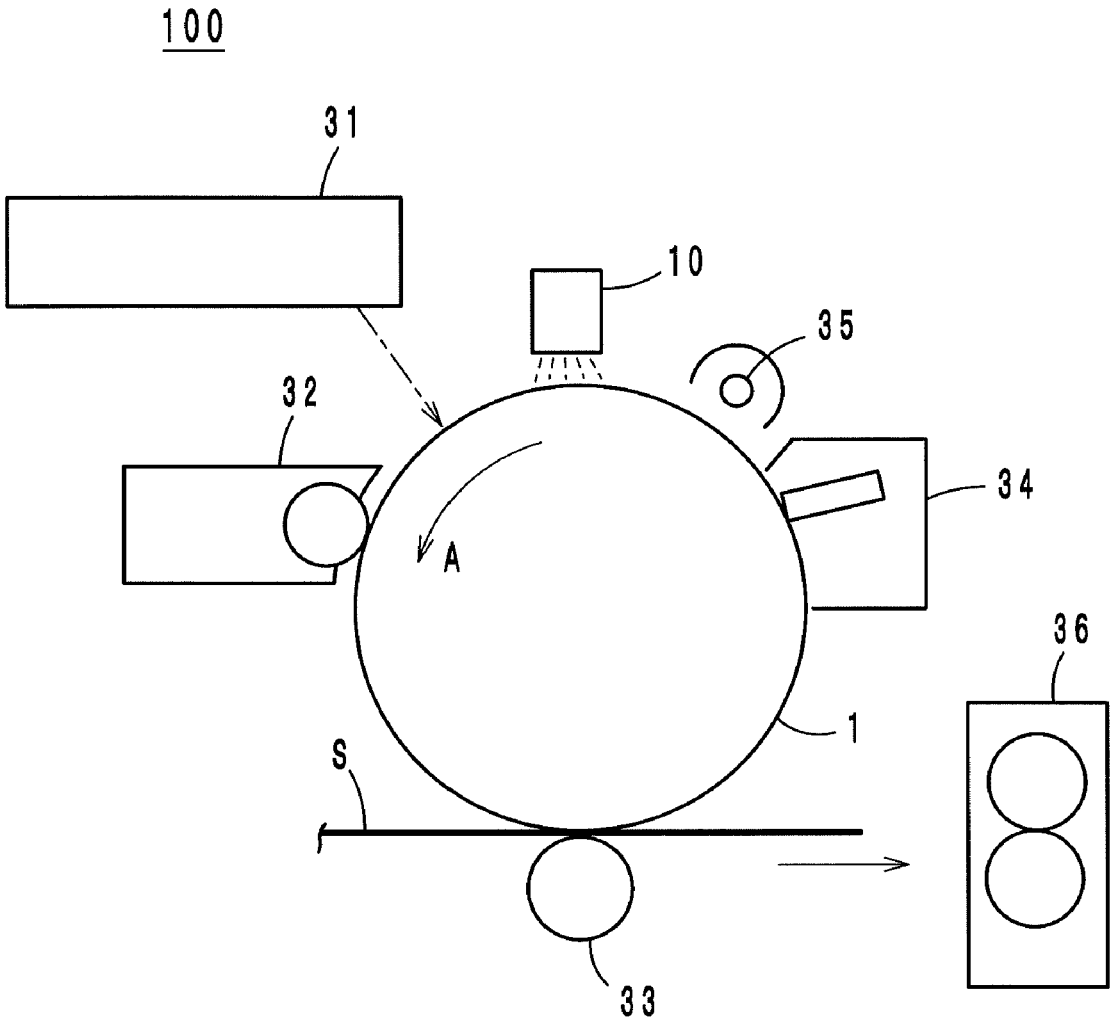
FIG. 1 is a skeleton framework of an image forming apparatus according to an embodiment of the present invention.

First, the general structure of an image forming apparatus according to an embodiment of the present invention is described. FIG. 1 shows the general structure of an image forming apparatus 100 according to an embodiment of the present invention. The image forming apparatus 100 according to this embodiment is a monochromatic or a color copying machine, printer, facsimile or a machine having these functions.

The image forming apparatus 100 comprises a photosensitive drum 1, a charging device 10, an optical scanning device 31, a developing device 32, a transfer roller 33, a cleaning device 34, an eraser lamp 35 and a fixing device 36. The photosensitive drum 1 is cylindrical and is driven by a motor (not shown) to rotate in a direction "A". An electrostatic latent image is formed on the surface of the photosensitive drum 1, and toner is applied to the surface thereof. Thus, the photosensitive drum 1 serves as an image bearing member for bearing a toner image in accordance with the electrostatic latent image.

The charging device 10 charges the surface of the photosensitive drum 1 evenly to a specified level. The optical scanning device 31 scans the surface of the photosensitive drum 1 with a beam modulated in accordance with image data and forms an electrostatic latent image on the surface of the photosensitive drum 1. The developing device 32 supplies toner onto the surface of the photosensitive drum 1, so that the electrostatic latent image is developed (visualized) into a toner image. The transfer roller 33 transfers the toner image formed on the surface of the photosensitive drum 1 to a sheet S traveling between the transfer roller 33 and the photosensitive drum 1. The fixing device 36 performs a heat/pressure treatment toward the sheet S so as to fix the toner on the sheet S.

The cleaning device 34 collects residual toner from the surface of the photosensitive drum 1. The eraser lamp 35 erases residual charge from the surface of the photosensitive drum 1.

Structure of the Charging Device

Figure 2:
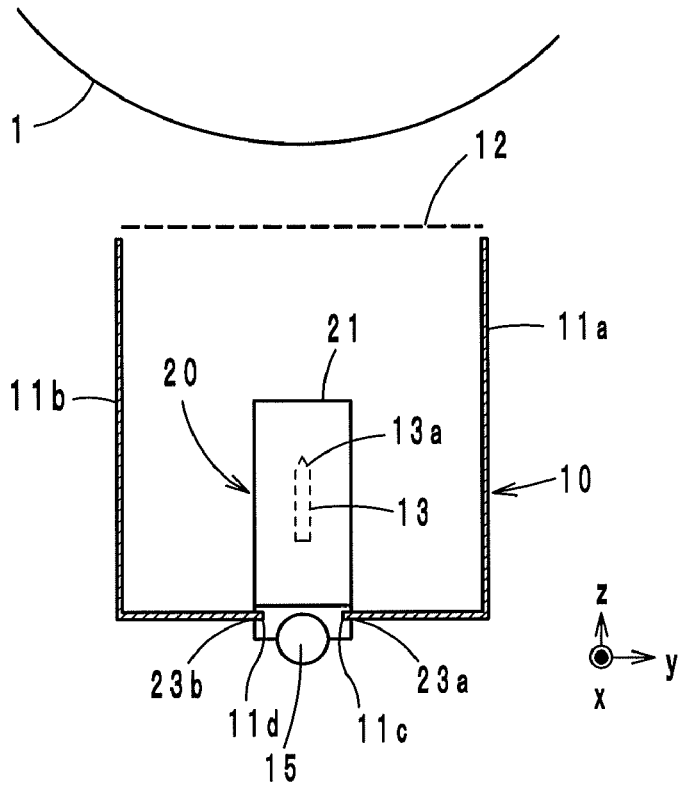
FIG. 2 is a skeleton framework of a charging device.
Figure 3:
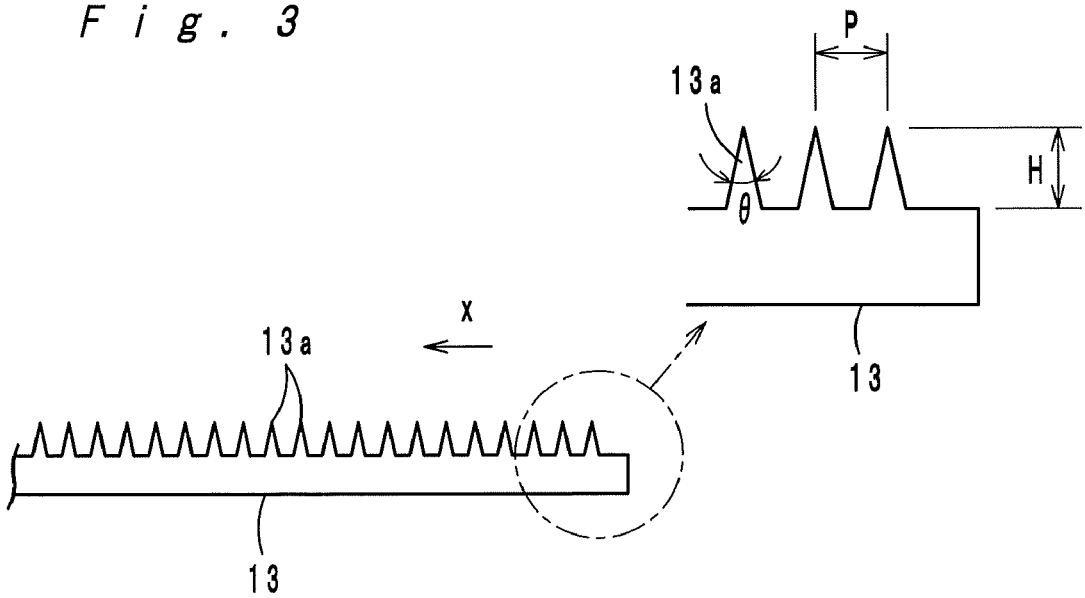
FIG. 3 is a configuration diagram of a sheet electrode provided in the charging device.
Figure 4A:
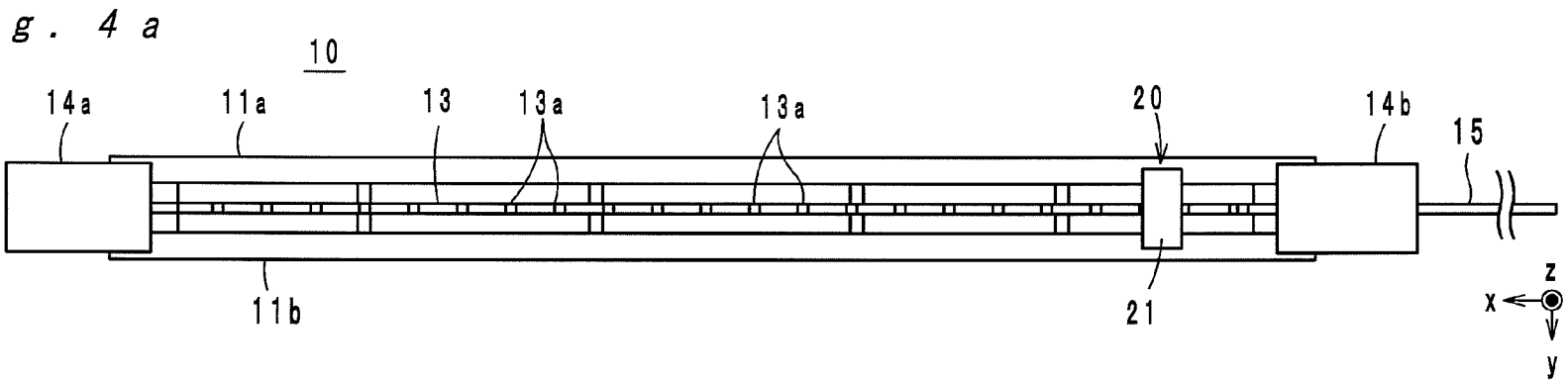
FIGS. 4*a*, 4*b* and 4*c* are configuration diagrams of the charging device.
Figure 4B:
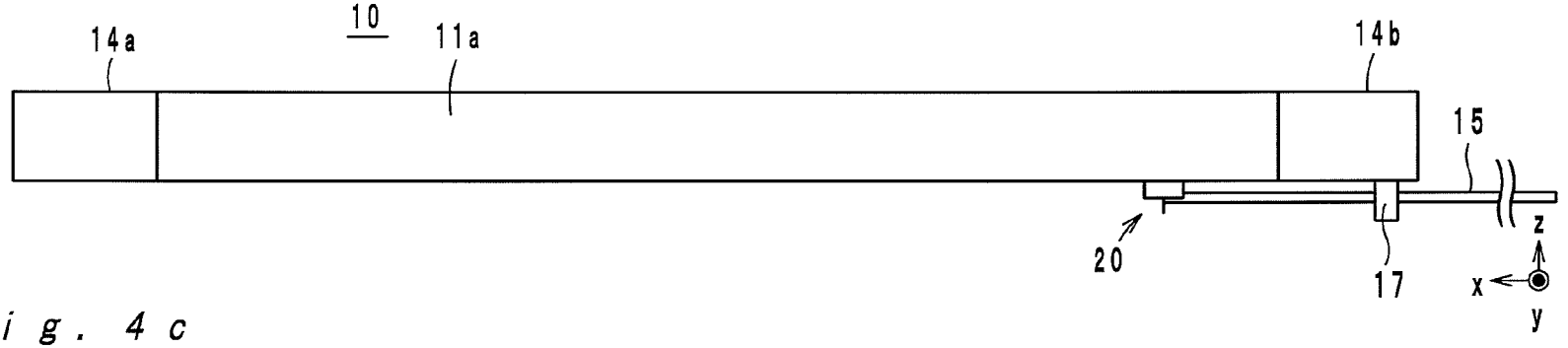
Figure 4C:
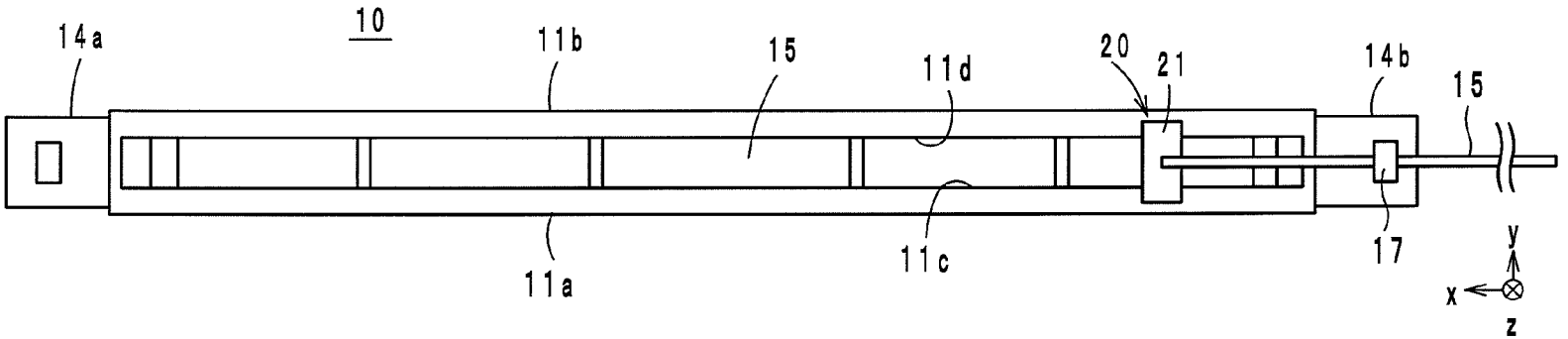
Figure 5:
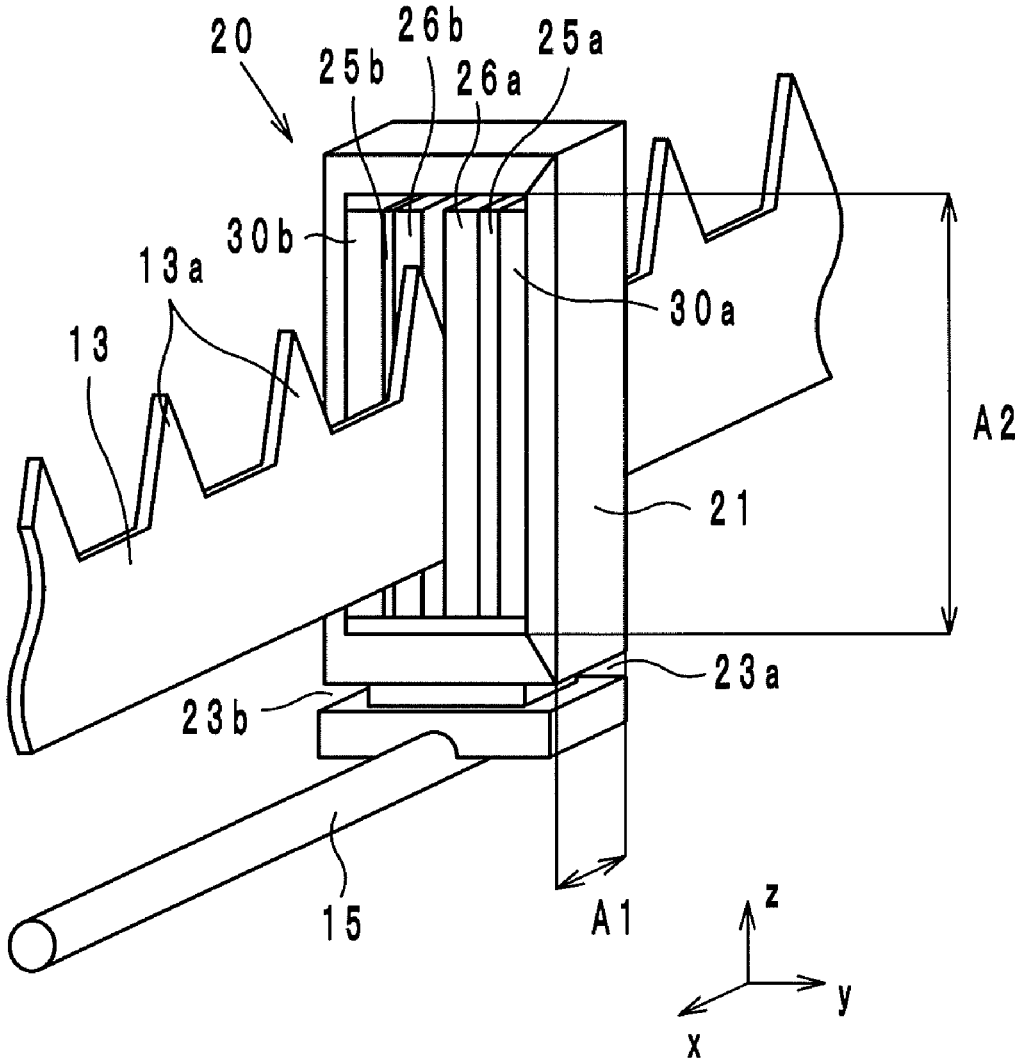
FIG. 5 is a perspective view of a cleaner unit.

Next, the structure of the charging device 10 is described. FIG. 2 shows the general structure of the charging device 10. FIG. 3 shows the structure of a sheet electrode 13 provided in the charging device 10. FIGS. 4*a*, 4*b* and 4*c* show the structure of the charging device 10. FIG. 4*a* is a plan view, FIG. 4*b* is a front view, and FIG. 4*c* is a bottom view. FIG. 5 is a perspective view of a cleaner unit 20. In the following paragraphs, the lengthwise direction of the charging device 10 (that is, main-scanning direction) is referred to as x direction, and the rotating direction of the photosensitive drum 1 (that is, sub-scanning direction) is referred to as y direction. The direction perpendicular to the x direction and the y direction is defined to be z direction.

As shown by FIGS. 2 and 4, the charging device 10 comprises stabilizing plates 11*a* and 11*b*, a mesh-type grid 12, a sheet electrode 13, holders 14*a* and 14*b*, a shaft 15, a support 17 and a cleaner unit 20.

The stabilizing plates 11*a* and 11*b* have lengths in the x direction, each having an L-shape cross section. More specifically, as shown by FIG. 2, the stabilizing plate 11*a* also has a dimension in the z direction, and the end portion of the plate 11*a* at the negative side in the z direction is bent to the negative side in the y direction. Also, the stabilizing plate 11*b* has a dimension in the z direction, and the end portion of the plate 11*b* at the negative side in the z direction is bent to the positive side in the y direction. As seen in the cross sectional view of FIG. 2, the stabilizing plates 11*a* and 11*b* are U-shape in combination. The stabilizing plates 11*a* and 11*b* that are combined into U-shape have an opening that faces to the photosensitive drum 1. The mesh-type grid 12 is disposed at the opening of the stabilizing plates 11*a* and 11*b*. As shown in FIGS. 4*a*, 4*b* and 4*c*, the holders 14*a* and 14*b* for holding the stabilizing plates 11*a*, 11*b* and the mesh-type grid 12 are disposed at both ends in the lengthwise direction of the stabilizing plates 11*a* and 11*b* (in the x direction).

The sheet electrode 13 is disposed in a space enclosed by the stabilizing plates 11*a*, 11*b* and the mesh-type grid 12 with its both ends held by the holders 14*a* and 14*b*. The sheet electrode 13 charges the surface of the photosensitive drum 1. In the following, the structure of the sheet electrode 13 is described in detail.

As shown by FIG. 3, on the sheet electrode 13, a multiple of triangular pins 13*a* are aligned in the x direction. The sheet electrode 13 has a thickness within a range from 40 μm to 60 μm. Each of the pins 13*a* has a vertex angle θ within a range from 5 degrees to 30 degrees and has a height H within a range from 1 mm to 3 mm. The pins 13*a* are arranged at a pitch P within a range from 1 mm to 3 mm. These values are designed for an efficient discharge. The sheet electrode 13 is made of stainless steel.

A voltage within a range from −6 kV to −7 kV (900 μA) is applied to the sheet electrode 13, and thereby, a corona discharge from the pins 13*a* to the photosensitive drum 1 occurs. Also, a voltage within a range from −300V to −900V is applied to the mesh-type grid 12, and thereby, the charge potential applied to the photosensitive drum 1 can be adjusted to a desired value.

As shown by FIG. 5, the cleaner unit 20 comprises a frame 21, resin plates 25*a* and 25*b*, grinding sheets 26*a* and 26*b*, and pressers 30*a* and 30*b*. The frame 21 is a parallelepiped, and a rectangular through-hole is made to pierce through the frame 21 in the lengthwise direction of the sheet electrode 13 (in the x direction). In other words, the frame 21 does not have surfaces on the sides in the x direction. In the frame 21, at the negative side in the z direction, grooves 23*a* and 23*b* are made to extend parallel to the x direction. As shown in FIG. 2, the end of the stabilizing plate 11*a* at the negative end in the y direction serves as a rail 11*c*, and the end of the stabilizing plate 11*b* at the positive end in the y direction serves as a rail 11*d*. The rails 11*c* and 11*d* engage with the grooves 23*a* and 23*b*, respectively. In this way, the frame 21 is disposed to be capable of sliding relative to the stabilizing plates 11*a* and 11*b* in the lengthwise direction of the stabilizing plates 11*a* and 11*b* (in the x direction).

As shown in FIG. 5, the resin plates 25*a* and 25*b*, the grinding sheets 26*a* and 26*b* and the pressers 30*a* and 30*b* are disposed in the through-hole of the frame 21. More specifically, the presser 30*a* is stuck on the inner surface of the side of the frame 21 that is at the positive side in the y direction as shown in FIG. 5, and the presser 30*a* is made of an elastic material. The presser 30*b* is stuck on the inner surface of the side of the frame 21 that is at the negative side in the y direction as shown in FIG. 5, and the presser 30*b* is made of an elastic material. Various elastic materials can be used for the pressers 30*a* and 30*b*. For example, urethane foam may be used as the material for the pressers 30*a* and 30*b*. The use of urethane foam is advantageous in that urethane foam is a foamed material with a bare possibility of permanent deformation and in that urethane foam is unresolved by ozone.

The resin plate 25*a* is stuck on the side of the presser 30*a* that is at the negative side in the y direction as shown in FIG. 5, and the resin plate 25*a* is made of a material harder than urethane foam, for example, made of PET. The resin plate 25*b* is stuck on the side of the presser 30*b* that is at the positive side in the y direction as shown in FIG. 5, and the resin plate 25*b* is made of a material harder than urethane foam, for example, made of PET. The resin plates 25*a* and 25*b* have thicknesses within a range from 0.5 mm to 1.0 mm.

Figure 6A:
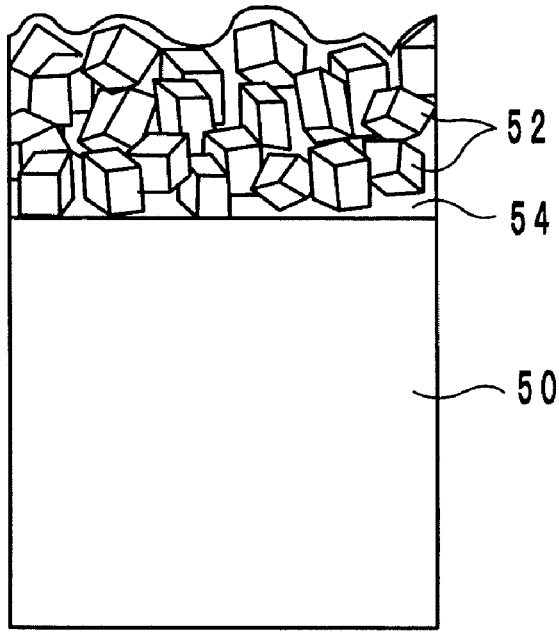
FIGS. 6*a* and 6*b* show a grinding sheet, FIG. 6*a* being a sectional view and FIG. 6*b* being a microgram.
Figure 6B:
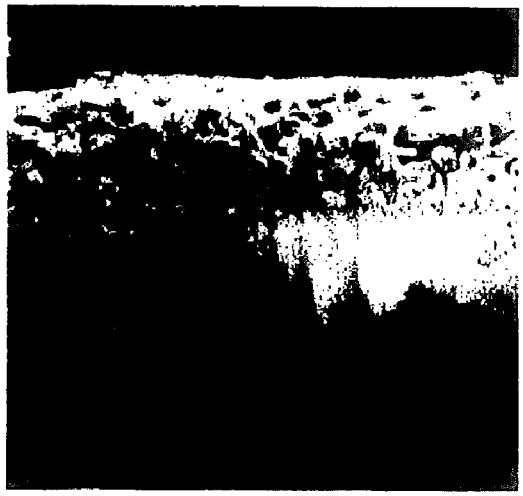

The grinding sheet 26*a* is stuck on the side of the resin plate 25*a* that is at the negative side in the y direction as shown in FIG. 5. The grinding sheet 26*b* is stuck on the side of the resin plate 25*b* that is at the positive side in the y direction as shown in FIG. 5. Accordingly, the grinding sheets 26*a* and 26*b* face to each other with a space in-between. FIG. 6*a* is a sectional view of the grinding sheets 26*a* and 26*b*, and FIG. 6*b* is a micrograph of the grinding sheets 26*a* and 26*b*. Each of the grinding sheets 26*a* and 26*b* comprises a PET film 50, abrasive grains 52 and a binder 54. The PET film 50 is a base sheet and has a thickness within a range from 5 μm to 75 μm. The average diameter of the abrasive grains 52 is within a range from 2 μm to 9 μm, and the abrasive grains 52 are scattered on the PET film 50. For the abrasive grains 52, for example, a metal oxide, such as aluminum oxide, chrome oxide and iron oxide, or silicone carbide is used. The binder 54 binds the abrasive grains 52 so that the abrasive grains 52 will not fall off the PET film 50. As shown by FIGS. 6*a* and 6*b*, the abrasive grains 52 are bound by the binder 54 to stick together densely without spaces. Thus, the abrasive grains 52 and the binder 54 form an abrasive layer, and the abrasive layer has a thickness that is equal to or greater than 10 μm. As the grinding sheets 26*a* and 26*b*, for example, wrapping film sheets made by 3M, namely, model A3-2SHT (average diameter: 2 μm), model A3-3SHT (average diameter: 3 μm), model A3-5SHT (average diameter: 5 μm) and model A3-9SHT (average diameter: 9 μm) may be used. The wrapping film sheets made by 3M comprise abrasive grains of aluminum oxide.

With the cleaner unit 20 of the structure above, as shown by FIG. 5, the sheet electrode 13 passes through the space between the grinding sheets 26*a* and 26*b*. Meanwhile, the grinding sheets 26*a* and 26*b* are pressed by the elastic pressers 30*a* and 30*b*, respectively, on the both sides of the sheet electrode 13.

As shown in FIG. 5, the shaft 15 is disposed on the lower surface of the side of the frame 21 that is at the negative side in the z direction, and the shaft 15 extends parallel to the x direction toward the negative side. The support 17 is fitted on the side of the holder 14*b* that is at the negative side in the z direction, and a through-hole is made in the support 17. The shaft 15 pierces through the through-hole of the shaft 17. Thus, the support 17 supports the shaft 15. In this structure, a user can reciprocate the cleaner unit 20 in the x direction by sliding the shaft 15 along the x direction. The force necessary to move the cleaner unit 20 relative to the sheet electrode 13 at a constant speed is preferably larger than 0N and smaller than 2.0N. In other words, it is preferred that a frictional force that is larger than 0N and smaller than 2.0N acts between the grinding sheet 26*a* and the sheet electrode 13 and between the grinding sheet 26*b* and the sheet electrode 13. The space between the grinding sheets 26*a* and 26*b* is so designed as to generate the frictional force. In order to achieve the designed space between the grinding sheets 26*a* and 26*b*, the thicknesses of the resin plates 25*a* and 25*b*, the grinding sheets 26*a* and 26*b* and the pressers 30*a* and 30*b* are adjusted.

Additionally, in order to generate an appropriate frictional force, it is necessary that the grinding sheets 26*a* and 26*b* apply a pressure uniformly to the sheet electrode 13. For this purpose, in the charging device 10, it is preferred that each of the pressers 30*a* and 30*b* is composed of ten or more cells arranged in the area of 3 mm (depth A1) by 6 mm (height A2) shown in FIG. 5. In this case, the pressers 30*a* and 30*b* are preferably made of urethane foam having a density within a range from 15 kg/m$^3$ to 60 kg/m$^3$.

With the cleaner unit 20 of the structure above, a user pushes the shaft 15 to the positive side in the x direction to move the cleaner unit 20 to the neighborhood of the holder 14*a*. Thereafter, the user pulls the shaft 15 to the negative side in the x direction to move the cleaner unit 20 to the neighborhood of the holder 14*b*. Thereby, the both sides of the sheet electrode 13 are ground by the grinding sheets 26*a* and 26*b*, respectively. Consequently, corona products adhering to the sheet electrode 13 can be removed therefrom.

Advantages

In the charging device 10, each of the pins 13*a* of the sheet electrode 13 has a vertex angle θ within a range from 5 degrees to 30 degrees, and the sheet electrode 13 has a thickness within a range from 40 μm to 60 μm. The abrasive grains 52 of the grinding sheets 26*a* and 26*b* have an average diameter within a range from 2 μm to 9 μm. Further, a force larger than 0N and smaller than 2.0N starts a uniform motion of the cleaner unit 20 and the sheet electrode 13 relative to each other. Due to this structure of the charging device 10, breaks of the triangular pins 13*a* of the sheet electrode 13 can be prevented. In the following, the advantages of the charging device 10 will be described with reference to results of experiments.

A first experiment is described. In the first experiment, in order to find out the conditions for preventing bends and/or abrasions of the pins 13*a*, the inventors fabricated various samples of the charging device 10. Then, the inventors operated the cleaner unit 20 in each of the samples and thereafter examined the pins 13*a* whether there were any bends/cracks or abrasions. More specifically, the inventors fabricated the first to the twenty-sixth samples shown by Table 1.

TABLE 1

| Sample No. | Abrasive Grains | Average Diameter (μm) | Frictional Force (N) |
|---|---|---|---|
| 1 | Aluminum Oxide | 1 | 1.5 |
| 2 | | | 2 |
| 3 | | | 2.5 |
| 4 | | 2 | 0.5 |
| 5 | | | 1 |
| 6 | | | 1.5 |
| 7 | | | 2 |
| 8 | | | 2.5 |
| 9 | | 3 | 0.5 |
| 10 | | | 1 |
| 11 | | | 1.5 |
| 12 | | | 2 |
| 13 | | | 2.5 |
| 14 | | 5 | 0.5 |
| 15 | | | 1 |
| 16 | | | 1.5 |
| 17 | | | 2 |
| 18 | | | 2.5 |
| 19 | | 8 | 1.5 |
| 20 | | | 2 |
| 21 | | | 2.5 |
| 22 | | 9 | 0.5 |
| 23 | | | 1 |
| 24 | | | 1.5 |
| 25 | | | 2 |
| 26 | | | 2.5 |

The values listed as the frictional force in Table 1 were obtained by connecting the sheet electrode 13 to a push-pull gauge and by reading the scale of the push-pull gauge when the sheet electrode 13 was pulled while the cleaner unit 20 was fixed. The other conditions for the experiment were as follows.

The thickness of the sheet electrode 13 was 50 μm; the pitch P of the pins 13*a* was 1 mm; the height H of the pins 13*a* was 2 mm; the vertex angle θ of the pins 13*a* was 10 degrees; the thickness of the resin plates 25*a* and 25*b* was 75 μm; the thickness of the grinding layers of the grinding sheets 26*a* and 26*b* was 20 μm; and the thickness of the PET film 50 was 75 μm.

In each of the first to the twenty-sixth samples above, the cleaner unit 20 was reciprocated twenty times, and thereafter, the pins 13*a* were examined whether there were any bends/cracks or abrasions. Table 2 shows the results of the experiment.

TABLE 2

| Sample No. | Bends/Cracks | Abrasions |
|---|---|---|
| 1 | X | ○ |
| 2 | X | ○ |
| 3 | X | ○ |
| 4 | — | — |
| 5 | — | — |
| 6 | Δ | ○ |
| 7 | Δ | ○ |
| 8 | X | ○ |
| 9 | ○ | ○ |
| 10 | ○ | ○ |

TABLE 2-continued

| Sample No. | Bends/Cracks | Abrasions |
|---|---|---|
| 11 | ○ | ○ |
| 12 | ○ | ○ |
| 13 | Δ | ○ |
| 14 | ○ | ○ |
| 15 | ○ | ○ |
| 16 | ○ | ○ |
| 17 | ○ | ○ |
| 18 | Δ | ○ |
| 19 | ○ | ○ |
| 20 | ○ | ○ |
| 21 | Δ | Δ |
| 22 | — | — |
| 23 | — | — |
| 24 | ○ | ○ |
| 25 | ○ | Δ |
| 26 | Δ | X |

In Table 2, a circle in the column of "Bends/Cracks" means that neither bends nor cracks occurred to the pins 13*a*. A triangle in the column of "Bends/Cracks" means that although some bends and/or cracks occurred to the pins 13*a*, the bends/cracks were in a small degree not to cause a problem. A cross in the column of "Bends/Cracks" means that some bends and/or cracks in such a degree to cause a problem occurred to the pins 13*a*. Here, to "cause a problem" means to cause image noise in forming an image. A dash in the column of "Bends/Cracks" means that the sample was not subjected to the experiment.

In Table 2, also, a circle in the column of "Abrasions" means that no abrasions occurred to the pins 13*a*. A triangle in the column of "Abrasions" means that although some abrasions occurred to the pins 13*a*, the abrasions were in a small degree not to cause a problem. A cross in the column of "Abrasions" means that some abrasions in such a degree to cause a problem occurred to the pins 13*a*. Here, to "cause a problem" means to cause image noise in forming an image. A dash in the column of "Abrasions" means that the sample was not subjected to the experiment.

Referring to Table 1 and Table 2, in the samples wherein the frictional force was equal to or less than 2N and the average diameter of the abrasive grains 52 was within a range from 2 μm to 9 μm (in the sixth and the seventh samples, the ninth to the twelfth samples, the fourteenth to the seventeenth samples, the nineteenth and the twentieth samples, and the twenty-fourth and the twenty-fifth samples), neither bends/cracks nor abrasions in such a degree to cause a problem occurred to the pins 13*a*. As a result of the first experiment, it was found out that when the sheet electrode 13 has the following specifications: the thickness of the electrode 13 is 50 μm the vertex angle θ of the pins 13*a* is 10 degrees; the pitch P of the pins 13*a* is 1 mm; and the height H of the pins 13*a* is 2 mm, it is possible to prevent bends/cracks and abrasions of the pins 13*a* by setting the frictional force to or less than 2N and by using abrasive grains with an average diameter within a range from 2 μm to 9 μm.

In the first experiment, the sheet electrode 13 was made to have a thickness of 50 μm. If the sheet electrode 13 is thicker, the sheet electrode 13 will be less liable to bend and/or crack. Therefore, the thickness of the sheet electrode 13 shall be equal to or greater than 50 μm. Further, for the sake of an efficient corona discharge, as mentioned above, the thickness of the sheet electrode 13 is preferably within a range from 40 μm to 60 μm. In the charging device 10, therefore, the thickness of the sheet electrode 13 is preferably within a range from 50 μm to 60 μm.

In the first experiment, the vertex angle θ of the pins 13*a* was ten degrees. If the vertex angle θ of the pins 13*a* is larger, the pins 13*a* will be stronger. Accordingly, if the vertex angle θ of the pins 13*a* is larger, the pins 13*a* will be less liable to bend and/or crack. Therefore, the vertex angle θ of the pins 13*a* of the sheet electrode 13 shall be equal to or greater than 10 degrees. Further, for the sake of an efficient corona discharge, as mentioned above, the vertex angle θ of the pins 13*a* of the sheet electrode 13 is preferably within a range from 5 degrees to 30 degrees. In the charging device 10, therefore, the vertex angle θ of the pins 13*a* of the sheet electrode 13 is preferably within a range from 10 degrees to 30 degrees.

The possibility that bends/cracks will occur to the pins 13*a* is hardly influenced by the height H of the pins 13*a*. In the first experiment, the bends/cracks of the pins 13*a* occurred in areas within 30 μm from the respective tips of the pins 13*a*. When the height H of the pins 13*a* is equal to or greater than 30 μm, the possibility that bends/cracks will occur to the pins 13*a* does not depend on the height H and depends on other conditions.

The pins 13*a* are bent/cracked and/or are abraded by contact with the grinding sheets 26*a* and 26*b*. The possibility that bends/cracks and/or abrasions will occur to the pins 13*a* does not depend on the pitch of the pins 13*a* and depends on other conditions.

Referring to Table 1 and Table 2, in the samples wherein the frictional force was equal to or less than 2N and the average diameter of the abrasive grains 52 was within a range from 3 μm to 8 μm (in the ninth to the twelfth samples, the fourteenth to the seventeenth samples, and the nineteenth and the twentieth samples), neither bends/cracks nor abrasions occurred to the pins 13*a*. Therefore, the frictional force is preferably equal to or less than 2N, and the average diameter of the abrasive grains 52 is preferably within a range from 3 μm to 8 μm.

Next, a second experiment is described. The second experiment was conducted to certify that the grinding sheets 26*a* and 26*b* are highly effective in cleaning the sheet electrode 13. In the second experiment, the sixteenth sample was used as a sample of the charging device 10, and a twenty-seventh sample was fabricated as a comparative example. The twenty-seventh sample was different from the sixteenth sample in that two pieces of pile fabric were used instead of the grinding sheets 26*a* and 26*b*. In each of the sixteenth sample and the twenty-seventh sample, a discharge was continued for 100 hours, and thereafter, the sheet electrode 13 was cleaned by the cleaner unit 20.

Figure 7:
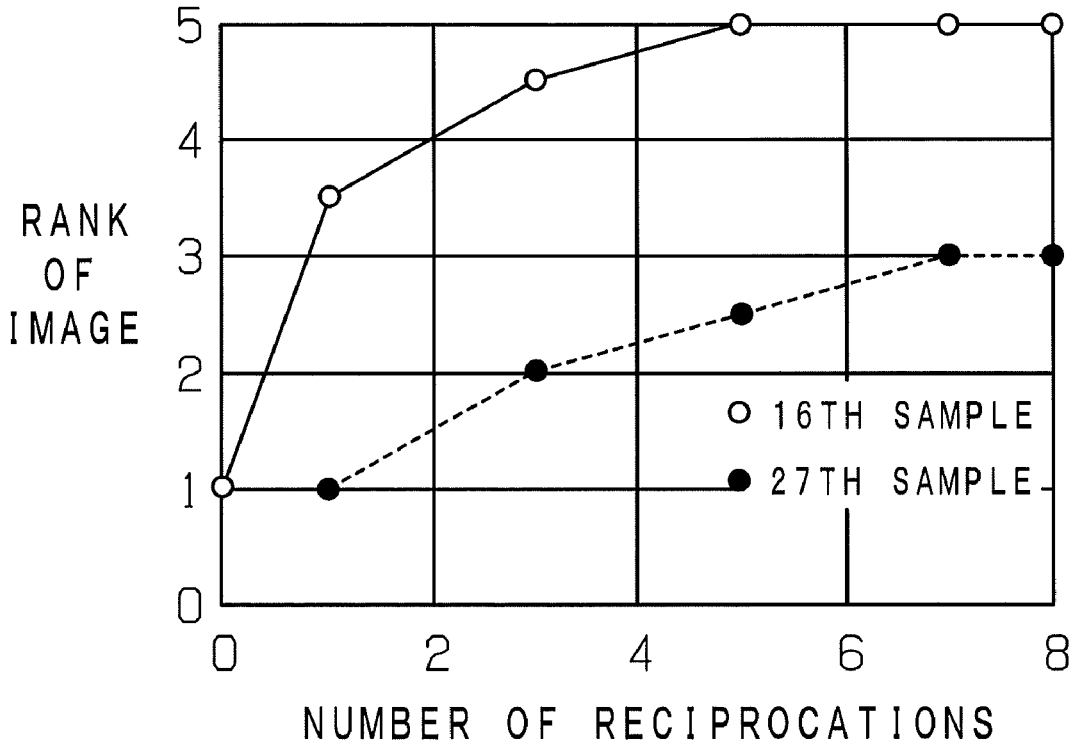
FIG. 7 is a graph showing the results of a second experiment.

FIG. 7 is a graph showing the results of the second experiment. The y axis shows the rank of image, and the x axis shows the number of reciprocations of the cleaner unit 20. The rank of image is determined by the width of a black stripe (image noise) that occurred on an image. More specifically, the rank 5 means that the width of a black stripe on an image was 0 mm. The rank 4 means that the width of a black stripe on an image was 1 mm. The rank 3 means that the width of a black stripe on an image was 1.5 mm. The rank 2 means that the width of a black stripe on an image was 2.5 mm. The rank 1 means that the width of a black stripe on an image was 4 mm. Images of rank 3 or more are good.

As shown by FIG. 7, in the twenty-seventh sample, one reciprocation of the cleaner unit 20 did not improve the rank of image, but in the sixteenth sample, one reciprocation of the cleaner unit 20 greatly improved the rank of image. Also, in the twenty-seventh sample, repetitious reciprocations of the cleaner unit 20 resulted in only rank 3, but in the sixteenth sample, repetitious reciprocations of the cleaner unit 20 resulted in rank 5. Thus, the use of the grinding sheets 26*a* and

26*b* is more effective in cleaning the sheet electrode 13, compared with the case of using pile fabric. The reason is that while the pile fabric merely wipes corona products, the grinding sheets 26*a* and 26*b* remove corona products from the sheet electrode 13 by grinding the sheet electrode 13 with abrasive grains.

Thus, in the charging device according to this embodiment, the cleaner unit 20 cleans the sheet electrode 13 effectively without breaking the triangular pins 13*a* of the sheet electrode 13.

Although the present invention has been described in connection with the embodiment above, it is to be noted that various changes and modifications are possible to those who are skilled in the art. Such changes and modifications are to be understood as being within the scope of the invention.

What is claimed is:

1. A charging device comprising:

a stainless steel sheet electrode for charging an image bearing member, the stainless sheet electrode having a thickness within a range from 50 μm to 60 μm and comprising aligned triangular pins, each of the triangular pins having a vertex angle within a range from 10 degrees to 30 degrees; and a cleaner for cleaning the stainless steel sheet electrode, the cleaner having two grinding members comprising abrasive grains having an average diameter within a range from 2 μm to 9 μm, the two grinding members being in contact with, respectively, both main surfaces of the sheet electrode, wherein the cleaner and the sheet electrode are moved relative to each other at a constant speed by a force equal to or less than 2N.

2. A charging device according to claim 1, wherein the abrasive grains have an average diameter within a range from 3 μm to 8 μm.

3. A charging device according to claim 1, wherein the abrasive grains are of a metal oxide.

4. A charging device according to claim 3, wherein the metal oxide is aluminum oxide, chrome oxide or iron oxide.

5. A charging device according to claim 1, wherein the abrasive grains are of silicon carbide.

6. An image forming apparatus comprising a charging device according to claim 1.

* * * * *